United States Patent [19]

Dreiling

[11] 4,278,309

[45] Jul. 14, 1981

[54] ALIGNMENT BRACKET FOR DRAWER-GUIDE SYSTEMS

[76] Inventor: Sebastian E. Dreiling, 2040 Conejo La., Fullerton, Calif. 92633

[21] Appl. No.: 109,228

[22] Filed: Dec. 31, 1979

[51] Int. Cl.[3] ..... A47B 88/00

[52] U.S. Cl. ..... 312/343; 248/261; 308/3.6; 312/345

[58] Field of Search ..... 312/331, 332, 342, 343, 312/345–348; 248/251, 261, 298; 308/3.6, 3.8

[56] References Cited

U.S. PATENT DOCUMENTS

| | | | |
|---|---|---|---|
| 3,149,811 | 9/1964 | Frenastad | 312/343 |
| 3,375,051 | 3/1968 | Anderson | 312/347 |
| 3,675,883 | 7/1972 | Holmes | 312/343 |
| 3,750,993 | 8/1973 | Read | 312/343 |

FOREIGN PATENT DOCUMENTS

| | | | |
|---|---|---|---|
| 1284594 | 12/1968 | Fed. Rep. of Germany | 248/298 |

*Primary Examiner*—Casmir A. Nunberg
*Attorney, Agent, or Firm*—Francis X. LoJacono

[57] ABSTRACT

An adjustable mounting bracket adapted to be movable in a vertical and/or horizontal plane, whereby a drawer and drawer-guide system can be aligned to prevent binding of the drawer within its supporting structure, the bracket comprising a first mounting plate adapted to be affixed to the drawer-supporting structure and including a nut member slidably mounted thereto to provide vertical movement, and the bracket comprising a second mounting plate having a horizontal slot adapted to receive a bolt therethrough for engagement with the vertically adjustable nut member, the second plate having a keeper member formed thereon to mount a drawer-guide member.

4 Claims, 5 Drawing Figures

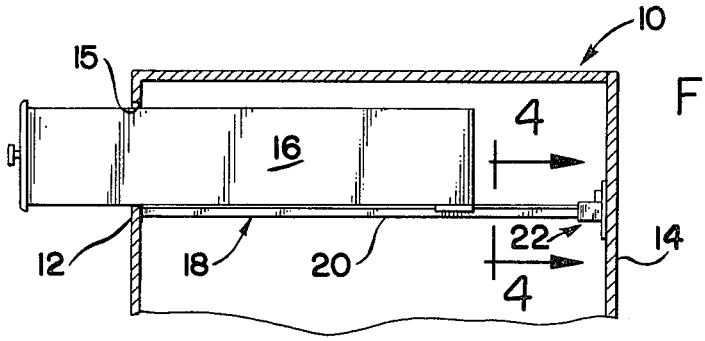
FIG. 1
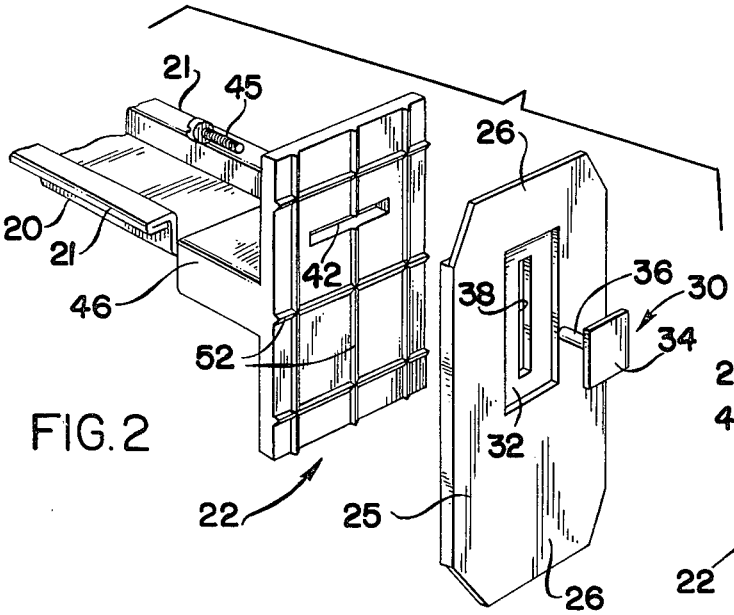
FIG. 2
FIG. 4
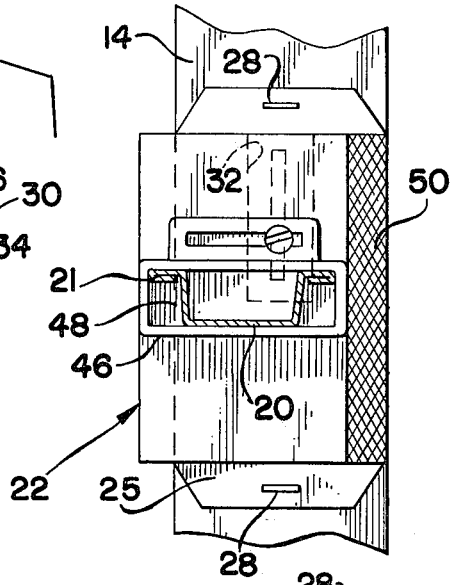
FIG. 3
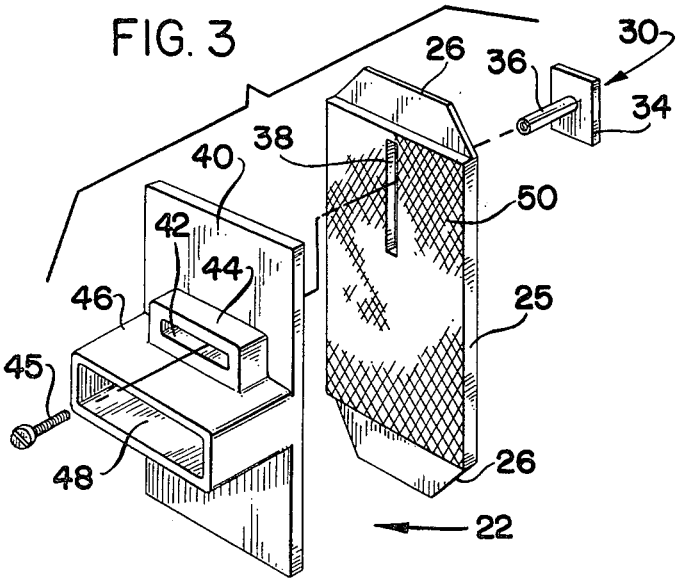
FIG. 5
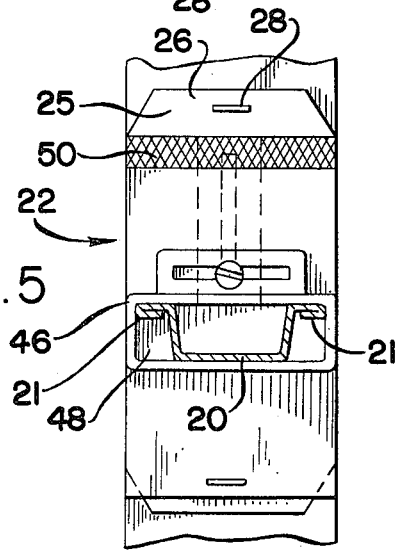

ALIGNMENT BRACKET FOR DRAWER-GUIDE SYSTEMS

BACKGROUND OF THE INVENTION

1. Field of the Invention

This invention relates generally to drawer-guide systems to allow drawers and the like to readily slide between an opened and closed position, and relates more particularly to an alignment device whereby a guide system can be aligned to prevent drawers from binding.

2. Description of the Prior Art

As is well known in the art, various problems and difficulties are encountered in providing a drawer-guide system with suitable means for aligning the related guide bars and supporting structure, so that the associated drawer will not bind from being misaligned.

There are many types and designs of drawer-guide systems. One type uses a central guide bar that is affixed between the rear portion of a drawer-support structure (herein referred to as a cabinet) and the front cross-bar. This type of slide is known as a single-track center-mounted drawer slide that incorporates the use of a rear-guide plate which is securely anchored to the rear portion of the drawer. The rail member of the slide is mounted to a rail socket, thus securing the rail to the rear of the cabinet, the front end of the rail being affixed as mentioned to a cross-bar. The rail at this time should be fixed within the cabinet, and aligned in parallel relation with the sides of the cabinet.

However, the aligned accuracy of the centrally positioned track is not always possible; and thus very often it must be adjusted when the complete cabinet unit is installed. This has been a well established problem in the installation of kitchen and bathroom cabinets in residential construction, etc.

There are other types of dual slide-bar mechanisms; and the same problem occurs with these also. Hence, there is a need for a simple adjustable bracket that can be adjusted at the time a drawer is positioned in the cabinet, without the need for repositioning the track of the supporting brackets.

SUMMARY AND OBJECTS OF THE INVENTION

The present invention has for an important object a provision wherein a rear-mounting-bracket assembly is formed in two parts—a first bracket plate and a second bracket plate. The first bracket plate is designed to be securely affixed to the rear structure of a cabinet, the plate having a vertically adjustable nut member mounted within a vertically arranged slot-and-recess combination. The second plate is formed having a horizontal slot so as to be juxtaposed with respect to the vertical slot, whereby a screw or bolt is passed through the second plate and engages the nut of the first plate, thereby providing a means to move the second plate in either or both directions.

It is another object of the invention to provide an adjustable bracket of this type wherein the second plate member includes a keeper member defined as a guide-socket member for mounting the guide track to the rear of the cabinet.

It is still another object of the invention to provide an adjustable bracket for slide systems wherein the guide socket can be of any suitable configuration—rectangular, square, round, etc., or even solid so as to match the configuration of the guide-track member.

It is a further object of the invention to provide a device of this type that allows the drawer to be moved in place prior to setting the bracket. Once the drawer is moved into place, the bracket can be secured in correct alignment by tightening the bracket bolt and nut, thereby securing the respective plates in their porperly aligned position for the particular drawer.

It is still a further object of the present invention to provide a device of this character that includes relatively few operating parts.

Still another object of this invention is to provide a bracket of this character that is relatively inexpensive to manufacture, and that is easy to service and maintain.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 1 is a pictorial cross-sectional view of a cabinet having a drawer therein showing a track slide mounted to the adjustable bracket disposed at the rear of the cabinet;

FIG. 2 is an exploded perspective view of the present invention showing the rear portions of the brackets;

FIG. 3 is an exploded perspective view showing the front face of the two bracket parts thereof;

FIG. 4 is an enlarged cross-sectional view showing the second plate offset laterally from the first fixed plate; and FIG. 5 is a similar cross-sectional view showing the second plate offset vertically lower from the central position.

DESCRIPTION OF THE PREFERRED EMBODIMENT

Referring more particularly to FIG. 1, there is shown a fixed support structure defining a typical cabinet, generally indicated at 10, having a front structure 12 and a rear structure 14, the front structure having an opening 15 formed therein to receive drawer 16. In order for drawer 16 to operate without binding, the cabinet side structures, the drawer 16, and the drawer-guide system (designated at 18) must be in parallel alignment with each other.

In this illustration, a typical single-track system is center mounted within cabinet 10—that is, the drawer-guide system comprises a single guide track 20 having its front end secured to the front structure 12 in any known suitable manner, the rear thereof being adjustably mounted to the present invention (designated generally at 22). Anchored securely to the rear of drawer 16 is a slide-guide member 24 that is adapted to be slidably mounted to guide track 20. Thus, drawer 16 can be pulled outwardly or pushed inwardly along track 20.

It should be noted that there are many shapes and numbers of guide systems; and the single unit as herein shown and described is by way of an example of the known art.

The alignment-bracket assembly as herein shown comprises a first rear mounting bracket 25 defined by a substantially flat plate having extended upper and lower ear members 26 which are formed to accept suitable fastening means, such as staple members 28 as seen in FIGS. 4 and 5. Thus, it can be seen that the rear-mounting-bracket member 25 is fixedly secured to rear cabinet structure 14. Prior to fastening rear bracket 25 to structure 14, a nut means 30 is positioned in an elongated and generally rectangular recess 32 formed in the rear surface of bracket 25. As shown in FIGS. 2 and 3, nut means 30 comprises a flat head 34 having a projecting boss member 36 which is internally threaded. Head 34 is provided with a rectangular configuration so as to readily fit within recess 32. The width of head 34 is the same as the width of recess 32; and the length of recess 32 is greater than the length of head 34. This allows head 34 to slide vertically up or down in recess 32. To provide vertical movement for boss 36, a central vertical slot 38 is formed in the front face of bracket 25. Thus, boss 36 extends through slot 38.

A second bracket member 40 defined by a substantially flat plate is formed to be adjustably mounted to the first bracket member 25. This is accomplished by a horizontal slot 42 which is positioned to be generally aligned with slot 38. Slot 42 is further defined by a protruding shoulder member 44. Accordingly, when both bracket members are clamped in adjoining relationship, a bolt 45 is passed through slot 42 to meet and engage boss 32 as it passes through slot 38 and extends into slot 42.

It should be noted at this point that boss 36 need not be threaded, if a self-threading screw is used in place of bolt 45.

Integrally formed as part of the second bracket member 40 is a projecting socket member 46. The socket member 46 is shown as being rectangular and includes a hollow compartment to receive one end of the guide track 20. The guide track 20 as herein illustrated is shown as a channelled member having outwardly extended flanges 21. Thus, in FIGS. 4 and 5, track 20 is shown positioned within the compartment. However, the overall configuration will vary in accordance with the configuration of the track. If track 20 is a tubular member, socket 46 may be formed as a solid member adapted to be inserted in the tubular track.

In order to provide a positive clamping means, there is further provided a knurled surface 50 which is formed on the front face of plate 25, and a plurality of both vertical and horizontal rib members 52 formed on the rear face of plate 40.

It is contemplated that first bracket 25 is to be secured to structure 14 with movable nut member 30 positioned therein, and then the second bracket is loosely attached to the first bracket by bolt 45. Track 20 is fitted into compartment 48 of socket 49. At this time, drawer 16 can be closed, whereby the second bracket member will adjust to the correctly aligned position. The drawer is then gently opened so that one can tighten bolt or screw 45, thereby binding ribs 52 with knurled surface 50. This can be accomplished before or after installation.

The invention and its attendant advantages will be understood from the foregoing description; and it will be apparent that various changes may be made in the form, construction and arrangement of the parts of the invention witout departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A bracket assembly for aligning drawer-guide systems comprising:

a first rear-bracket member adapted to be fixedly secured to a fixed drawer-support structure, said first bracket member including a recess vertically disposed in the rear surface thereof, and a slot vertically disposed on the front surface thereof centrally positioned with respect to said recess and communicating therewith, to allow vertical adjustment of said bracket assembly;

a second front-bracket member adapted to be selectively coupled and positioned relative to said first bracket member, said second bracket member including a slot horizontally disposed therein and positioned to be juxtaposed with said slot of said first bracket member, thereby allowing said second bracket to be fixedly positioned vertically, horizontally, or angularly, with respect to said first fixed bracket;

a socket member integrally formed on said second bracket member for adjustably mounting a guide-track member; and a nut member adapted to be movably received in said recess of said first bracket member, having a threaded securing member adapted to be received in said slots to engage said nut member, whereby the simple tightening of said threaded securing member locks said second bracket member in aligned placement with respect to said drawer-guide systems.

2. A bracket assembly as recited in claim 1, wherein said nut member comprises a flat head adapted to be slidably positioned in said recess and an outwardly extending boss member adapted to be received in said slots for vertical positioning therein.

3. A bracket assembly as recited in claim 1, wherein the front surface of said first bracket is scored and wherein the rear surface of said second bracket is scored, whereby said first and second brackets are held in a clamped position.

4. A bracket assembly as recited in claim 3, wherein said scored surface of said first bracket comprises a plurality of knurls and wherein said scored surface of said second bracket comprises a plurality of vertical and horizontal rib members.

* * * * *